United States Patent [19]

Takamatsu

[11] Patent Number: 5,074,254

[45] Date of Patent: Dec. 24, 1991

[54] FORCED-CIRCULATION TYPE WATER-COOLING SYSTEM FOR HORIZONTAL INTERNAL-COMBUSTION ENGINE

[75] Inventor: Yoshimichi Takamatsu, Osaka, Japan

[73] Assignee: Kubota Ltd., Osaka, Japan

[21] Appl. No.: 492,373

[22] Filed: Mar. 9, 1990

Related U.S. Application Data

[63] Continuation of Ser. No. 200,118, May 27, 1988, abandoned.

[30] Foreign Application Priority Data

May 29, 1987 [JP] Japan ..... 62-83811[U]
Jul. 30, 1987 [JP] Japan ..... 62-117702[U]
Jul. 30, 1987 [JP] Japan ..... 62-191997

[51] Int. Cl.[5] ..... F01P 5/10

[52] U.S. Cl. ..... 123/41.44; 123/2; 123/41.82 R

[58] Field of Search ..... 123/198 E, 41.44, 196 W, 123/195 C, 198 C, 41.74, 41.82 R, 41.49, 2; 290/1 A, 1 B

[56] References Cited

U.S. PATENT DOCUMENTS

| | | | |
|---|---|---|---|
| 1,564,059 | 12/1925 | Goldberg | 123/198 E |
| 1,638,146 | 8/1927 | Buchenberg | 290/1 B |
| 1,947,713 | 2/1934 | Gumpper | 123/198 E |
| 2,004,405 | 6/1935 | Gumpper | 290/1 A |
| 2,019,476 | 11/1935 | Brownlee | 123/41.46 |
| 2,086,439 | 7/1937 | Rushmore | 123/41.44 |
| 2,086,441 | 7/1937 | Rushmore | 123/41.44 |
| 2,294,951 | 9/1942 | Baker | 123/41.44 |
| 2,499,176 | 2/1950 | Barrell | 123/41.49 |
| 4,122,353 | 10/1978 | Noguchi | 290/1 A |
| 4,241,702 | 12/1980 | Takeuchi et al. | 123/198 E X |
| 4,548,164 | 10/1985 | Ylönen et al. | 123/198 E X |
| 4,716,984 | 1/1988 | Hiramatsu et al. | 123/195 HC |

FOREIGN PATENT DOCUMENTS

| | | | |
|---|---|---|---|
| 47-10583 | 4/1972 | Japan . | |
| 9942 | 1/1978 | Japan | 123/198 E |
| 112820 | 9/1980 | Japan | 123/198 E |
| 22028 | 2/1985 | Japan | 123/198 E |

*Primary Examiner*—Noah P. Kamen
*Attorney, Agent, or Firm*—Lowe, Price, LeBlanc & Becker

[57] ABSTRACT

In a forced-circulation type water-cooling system for a horizontal internal-combustion engine, a radiator is located roughly at the same height as an engine body in a surrounding space outside a cylinder head and is positioned at a lateral side of the engine body of the horizontal internal-combustion engine. A cooling water inlet for a water jacket and a pump mounting seat for a water pump are provided at one of the front and back opposite sides of the cylinder head, at the same side as where an engine a rotation shaft such as crankshaft of the engine or a gear casing thereof projects from one of the front and back opposite sides of the engine body. The water pump is mounted on the pump mounting seat with its pump shaft extending in the fore and back direction. A pump driving wheel is fixedly secured to the engine rotation shaft, and a pump input wheel is fixedly secured to the pump shaft. The pump driving wheel and the pump input wheel are interlockingly connected to each other through a wrapping connector. The cooling water within the radiator is adpated to be delivered under pressure to a water jacket and circulated to the radiator by the water pump.

10 Claims, 9 Drawing Sheets

FORCED-CIRCULATION TYPE WATER-COOLING SYSTEM FOR HORIZONTAL INTERNAL-COMBUSTION ENGINE

This application is a continuation of application Ser. No. 07/200,118 filed May 27, 1988 now abandoned.

FIELD OF THE INVENTION

The present invention relates to a forced-circulation type water-cooling system for a horizontal internal-combustion engine, wherein the cooling water within a radiator is adapted to be delivered under pressure to a water jacket as well as circulated to the radiator by means of a water pump.

BACKGROUND OF THE INVENTION

A forced-circulation type water-cooling system for a horizontal internal-combustion engine, disclosed in Japanese Utility Model Publication No. 1972-10583, is constructed as shown in FIG. 19.

In this system a cooler 110 such as a radiator is located roughly at the same level as an engine body 107 of a horizontal internal-combustion engine 106 in a lateral space outside the engine body 107. A water jacket 122 comprises a cylinder jacket 123 formed within a cylinder block 113 and a head jacket 124 formed within a cylinder head 117. Head jacket 124 is provided with a cooling water inlet 156 at the underside thereof and the cylinder jacket 123 is provided with a hot water outlet 158 at the upper portion thereof. The hot water outlet 158 and the upper portion of the cooler 110 are connected to each other by a hot water pipe 159, and the lower portion of the cooler 110 and the cooling water inlet 156 are connected each other by a cool water pipe 160. A water pump 162 is interposed in an intermediate portion of the cool water pipe 160 in a space under the cylinder head 117. The cooling water within the cooler 110 is adapted to be delivered under pressure through the cool water pipe 160 to the water jacket 122 and circulated through the hot water pipe 159 to the cooler 110 by means of the water pump 162.

The following problems are associated with said conventional construction.

(a) The size of an internal-combustion engine becomes large.

When the water pump 162 is located in a narrow space under the cylinder head 117, the lower portion of the water pump 162 cannot help projecting downwardly from the underside of the engine body 107. The overall height of the engine body 107 increases correspondingly so that projecting extent and the size of an internal-combustion engine 106 are enlarged.

(b) The supporting construction and an alignment adjusting arrangement for a water pump are complicated.

First of all, since a pump supporting frame (not shown) is required only for supporting the water pump 162, a supporting construction for the water pump 162 is complicated.

As for driving the water pump 162, the simpliest arrangement that a pump shaft is interlockingly connected to a crankshaft 134 of the engine body 107 through a wrapping connector such as a belt transmission means. For accomplishing the simplest arrangement, it is necessary to accurately adjust the pump input wheel fixed to the pump shaft in the axial direction of the pump shaft relative to the pump driving wheel fixedly secured to the crank shaft 134 projecting from the engine body 107 in the fore and back direction. In such a conventional construction, since it is required to mount the engine body 107 and the pump supporting frame separately on a common base, any mounting error in the direction of the pump shaft becomes significant. In order to correct such an error, an adjusting shifter means is required for adjustably shifting the water pump 162 in the axial direction of the pump shaft on the pump supporting frame.

Consequently, the supporting construction and the alignment adjusting arrangement for the water pump 162 become complicated.

(c) It is difficult to cool the entire cylinder head intensively.

Generally in a water-cooled horizontal internal-combustion engine, a head jacket 124 is provided with jacket communication ports 125 to interconnect the cylinder jacket 123 and the head jacket 124 at the upper and the lower portions in the middle of the fore and back direction thereof.

Since the cooling water delivered under pressure by means of the water pump 162 is adapted to be ejected upwardly through the middle portions in the fore and back direction within the head jacket 124 from the cool water inlet 156 and then the ejected upper water flows into the cylinder jacket 123 through the jacket communication ports 125 in large quantities, the cooling water flow through the fore and back opposite portions in the head jacket 124 is reduced and, as a result, it is difficult to perform intensive cooling throughout the cylinder head 117.

(d) The engine is subjected to a large thermal strain.

Since the fore and back opposite portions of the cylinder head 117 are not cooled enough while the middle portions thereof in the fore and the back direction are cooled intensively, a large thermal strain tends to be caused in the cylinder head 117 by a large temperature difference therebetween.

SUMMARY OF THE INVENTION

An object of the present invention is to reduce the size of a horizontal internal-combustion engine, to simplify a supporting construction and an alignment adjusting arrangement for a water pump, to thereby perform intensive cooling throughout a cylinder head and reduce thermal strain in the cylinder head.

For accomplishing the above-mentioned objects, a forced-circulation type water-cooling system for a horizontal internal-combustion engine according to the present invention is constructed as follows.

A radiator is located roughly at the same height as an engine body in a surrounding space outside a cylinder head positioned at the lateral side of the engine body. A cool water inlet for a water jacket and a mounting seat for a water pump are provided at one of the front and back opposite sides of the cylinder head, preferably at the same side as where a rotation shaft such as a crankshaft or a gear casing projects from one of the front and back opposite sides of the engine body. The water pump is mounted on the mounting seat with its pump shaft extending in the fore and back direction. A pump driving wheel is fixedly secured to the rotation shaft, and a pump input wheel is fixedly secured to the pump shaft. And the pump driving wheel and the pump input wheel are interlockingly connected to each other through a wrapping connector provided therebetween.

Accordingly, the present invention has the following advantages.

(a) The size of a horizontal internal-combustion engine is reduced.

Since the water pump can be mounted advantageously in a lateral space outside a projecting portion including a rotation shaft such as a flywheel and an output shaft or a gear casing, the water pump can be prevented from projecting outside the rectangular space provided for the engine body. Therefore, since the height of the engine body can be decreased without increasing the size thereof in the fore and back direction as well as in the transverse direction, the size of the horizontal internal-combustion engine can be reduced.

(b) The supporting construction and alignment adjusting arrangement for a water pump can be simplified.

First of all, since the water pump is mounted onto a cylinder head, a supporting frame provided solely for the pump can be omitted.

Next, since the water pump is mounted onto the engine body which has been precisely assembled, mounting error in the axial direction of the pump shaft can be prevented from being caused at the time of the mounting of the water pump, and the pump input wheel for the water pump can be aligned exactly in the axial direction thereof relative to a pump driving wheel fixedly secured to the rotating shaft such as a crankshaft. Therefore, an adjusting shifter means for adjusting a water pump axially can be omitted.

Accordingly, the supporting construction and the alignment adjusting arrangement for the water pump can be simplified.

(c) The entire cylinder head can be cooled intensively.

The cooling water delivered under pressure by means of a water pump is adapted to flow vigorously through the middle portions of a cylinder head in the vertical direction from one of the fore and back opposite sides thereof, then impinges against the other side thereof, turning and separating into two streams (an upper one) and lower one and flows out to a cylinder jacket through upper and lower jacket communication ports after a vigorous circulation through upper and lower half portions of a head jacket. In this way, since the cooling water circulates vigorously and flows sufficiently throughout the head jacket, all of the cylinder head can be cooled intensively.

(d) Thermal strain in the cylinder head can be reduced.

As mentioned above, since the whole of a cylinder head is cooled intensively, an even thermal condition can be attained in the cylinder head and as the result the thermal strain can be reduced therein.

(e) In the horizontal internal combustion engine as constructed above, the pump input wheel and radiator fan are fixedly secured to the outwardly forward or backward projecting end portion of the pump shaft of the water pump and the radiator is arranged so as to be oriented to the radiator hence the radiator fan can be driven by a driving means for the water pump. As the result, the driving means used solely for the radiator fan can be omitted, and the transmission arrangement for the internal combustion engine can be simplified totally.

BRIEF DESCRIPTION OF THE DRAWINGS

FIGS. 1 through 9 show a first preferred embodiment thereof;

FIG. 1 is a schematic perspective view showing a soundproof type engine generator having a horizontal internal-combustion engine and a generator arranged within a soundproof casing;

FIG. 2 is a vertical sectional front view of said engine generator;

FIG. 3 is a horizontal sectional plan view of said engine generator;

FIG. 4 is a sectional view on IV—IV line in FIG. 2;

FIG. 5 is a view on V—V line in FIG. 4;

FIG. 6 is a partial view showing a first variant example corresponding to FIG. 4;

FIGS. 7 through 9 show a second variant example;

FIG. 7 is a view corresponding to FIG. 4;

FIG. 8 is a view on VIII—VIII line in FIG. 7;

FIG. 9 is a view on IX—IX line in FIG. 7.

FIGS. 10 through 13 show the second embodiment of the system;

FIG. 10 is a view corresponding to FIG. 1;

FIG. 11 is a view corresponding to FIG. 2;

FIG. 12 is a view corresponding to FIG. 3;

FIG. 13 is a partial view corresponding to FIG. 4;

FIGS. 14 through 18 show the third embodiment of the system;

FIG. 14 is a view corresponding to FIG. 1;

FIG. 15 is a view corresponding to FIG. 2;

FIG. 16 is a view corresponding to FIG. 3;

FIG. 17 is a horizontal sectional plan view of an engine body;

FIG. 18 is a partial view corresponding to FIG. 4; and

DESCRIPTION OF THE PREFERRED EMBODIMENTS

The embodiments of the present invention will now be explained with reference to the drawings hereinafter.

FIGS. 1 through 9 show the first embodiment.

Figure 1:
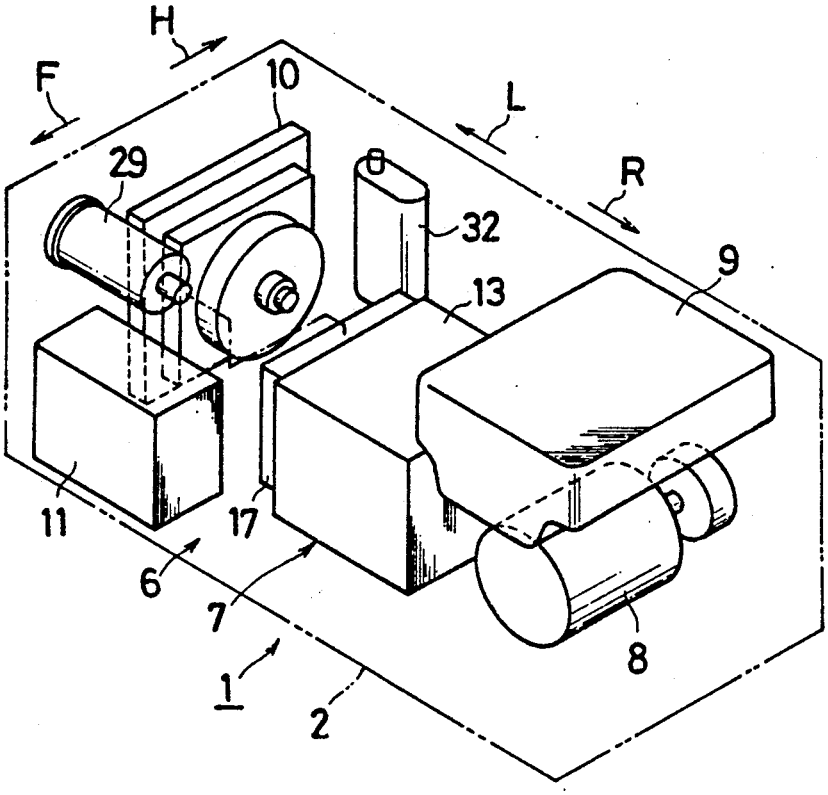
FIGS. 1 through 18 show the embodiments of the present invention.
Figure 3:
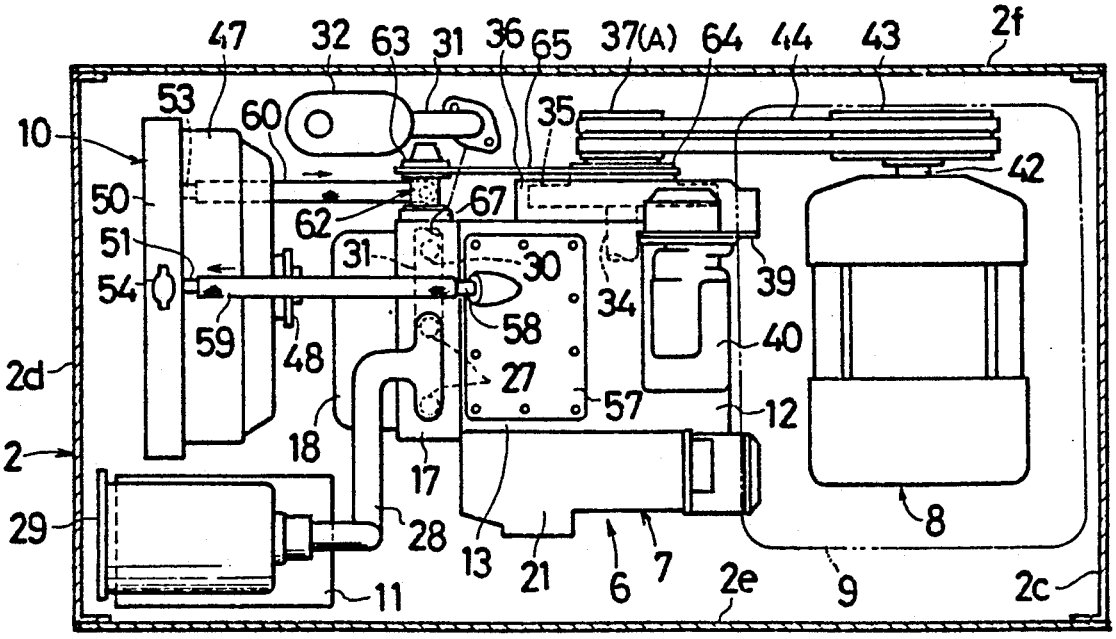
Figure 2:
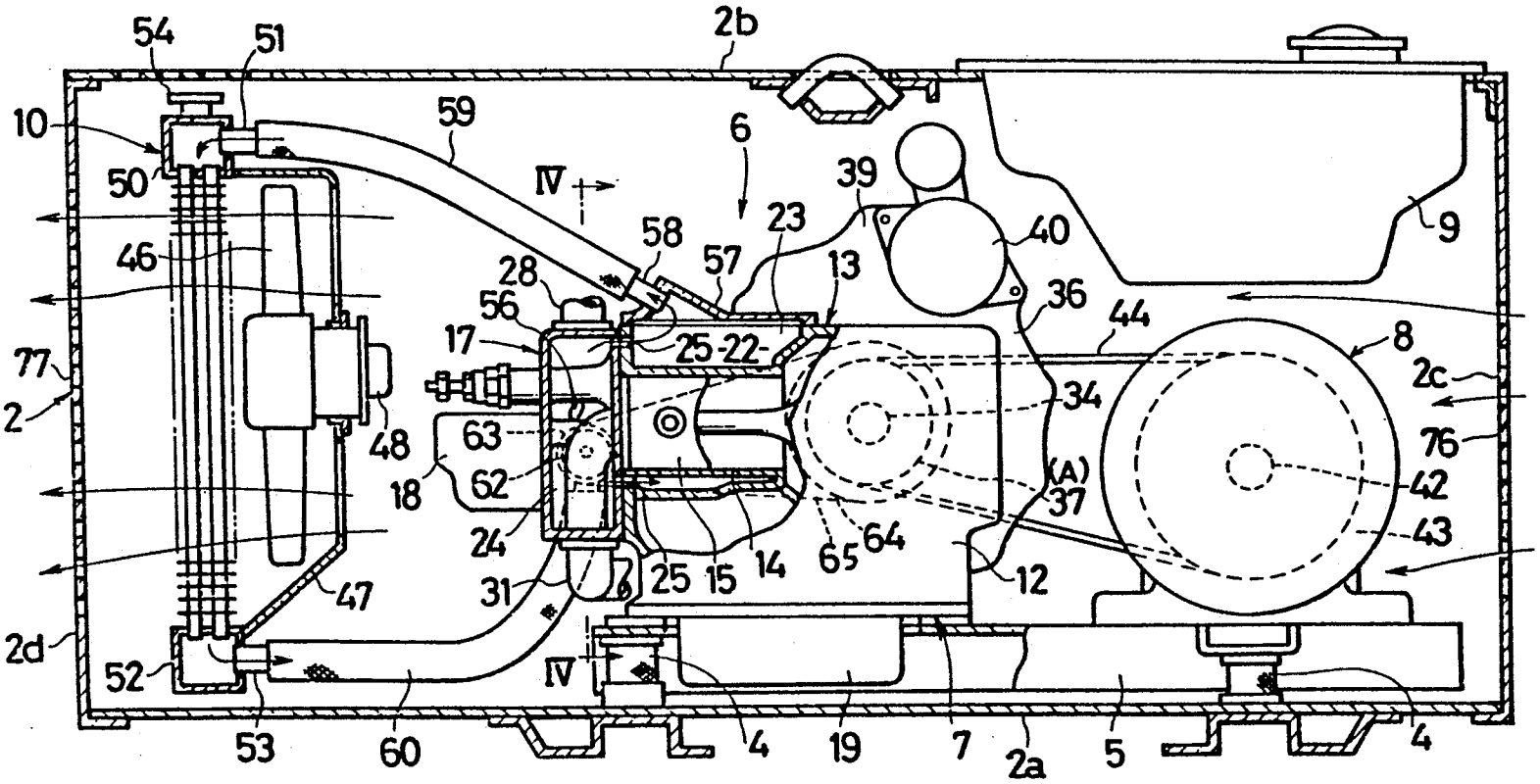

In FIGS. 1 through 3, the symbol 1 indicates a soundproof type engine generator, and 2 a soundproof casing thereof. The soundproof casing 2 is formed in a laterally elongated configuration including a front side shown by the arrow F, a back side shown by the arrow H, a left side shown by the arrow L in the front view and a right side shown by the arrow R, in the front view respectively, in FIG. 1.

The soundproof casing 2 has six walls assembled sealingly like a rectangular cover and is provided with a common base 5 supported on a bottom wall 2*a* through a plurality of vibro-isolating rubber members 4. On the common base 5, the engine body 7 of a water-cooled horizontal internal-combustion engine 6 and a generator 8 are mounted in parallel at the left and the right respectively. A fuel tank 9 is fixedly secured to the upper wall 2*b* of the soundproof casing 2 in a suspended manner above the generator 8. In the left side space outside the engine body 7, there is provided a radiator 10 roughly at the same height as the engine body 7. A battery 11 is located in front of the radiator 10. The inner wall surfaces of the soundproof casing 2 are provided with a soundproof material (not shown in the drawings).

The structure above-mentioned internal-combustion engine 6 will be explained in detail.

The engine body 7 is formed, for example for a water-cooled two-cylinder diesel engine, which has a cylinder block 13 formed integrally with a crankcase 12 and equipped with two cylinders 14, 14 whose axes are laterally horizontal and arranged in parallel relative to the fore and back direction. A piston 15 is slidingly fitted into each cylinder 14. At the left side of the cylinder block 13, a cylinder head 17 and a head cover 18 are fixedly secured in order. The cylinder block 13 has an oil pan 19 protruded from the underside and a gear casing 21 protruded from the front side thereof. A water jacket 22 of the engine body 7 comprises a cylinder jacket 23 provided within the cylinder block 13 and a head jacket 24 provided within the cylinder head 17, both of which are interconnected each other through a plurality of jacket communication ports 25.

Intake ports 27, 27 provided in the upper side of the cylinder head 17 are connected to an air-cleaner 29 through an intake pipe 28. The air-cleaner 29 is arranged above the battery 11. On the other hand, exhaust ports 30, 30 provided in the lower side of the cylinder head 17 are connected to a muffler 32 through an exhaust pipe 31. The muffler 32 is located at the back side within the soundproof casing 2.

Crankshaft 34 is provided at the central portion of the cylinder block 13 so as to project backwardly from the backside thereof, and a flywheel 35 is fixedly secured to the projecting end portion of the crankshaft 34. The flywheel 35 is covered with a flywheel cover 36 and provided with an output driving pulley 37 protruded as a rotation shaft A from the backside of the flywheel 35. Further, a starter motor 40 is fixedly secured on the back portion of the cylinder block 13 through a bracket 39. The starter motor 40 is electrically connected to the battery 11, and a starting pinion of the starter motor 40 is adapted to engage a ring gear of the flywheel 35.

The generator 8 is so arranged that an input shaft 42 thereof is in parallel with the crankshaft 34 of the engine body 7, and has an input pulley 43 is fixedly secured to the projecting end portion of the input shaft 42. Around both the input pulley 43 and the driving pulley 37, a driving belt 44 is looped continuously under tension.

The forced-circulation type water-cooling system for the internal-combustion engine 6 is arranged as follows.

The radiator 10 is so arranged that it extends in the fore and back direction within the lateral outer space of the cylinder head 17, and is constructed as a forced draft type. That is, the right side of the radiator 10 serves as an air inlet side, and there are provided a radiator fan 46, a fan casing 47 and a fan-driving motor 48. A hot water inlet 51 projects from an upper tank 50 of the radiator 10 and a cooling water outlet 53 projects from a lower tank 52 thereof rightwardly respectively. The upper tank 50 is further provided with a water feed cap 54 at the upper wall thereof.

On the other hand, the water jacket 22 has a cooling water inlet 56 provided at the back side of the cylinder head 17 and a hot water outlet 58 provided in a jacket cover 57 of the cylinder jacket 23. Accordingly, the hot water inlet 51 of the radiator 10 is located at the position near the hot water outlet 58 of the water jacket 22, and the cooling water outlet 53 of the radiator 10 is located at the position near the cooling water inlet 56 of the water jacket 22. The hot water outlet 58 and the hot water inlet 51 of the radiator 10 are interconnected through a flexible hot water pipe 59 made of rubber and the like substantially in the shortest distance. The cooling water outlet 53 of the radiator 10 and the cooling water inlet 56 of the water jacket 22 are interconnected through a flexible cool water pipe 60 substantially in the shortest distance. The hot water pipe 59 and the cool water pipe 60 may be formed of rigid pipes. With the flexible pipe as mentioned above, the piping work can be carried out more conveniently owing to the greater freedom of such piping.

Between the cooling water inlet 56 and the cool water pipe 60, there is interposed a water pump 62, which is interlockingly connected to the rotation shaft A provided in the back portion of the crankshaft 34. That is, a pump input pulley 63 as a pump input wheel is connected to the water pump 62, and a pump driving pulley 64 as a pump driving wheel is provided between the flywheel 35 and the generator driving pulley 37. A driving belt 65 as a wrapping connector is looped continuously around the pump driving pulley 64 and the pump input pulley 63 under tension.

Figure 4:
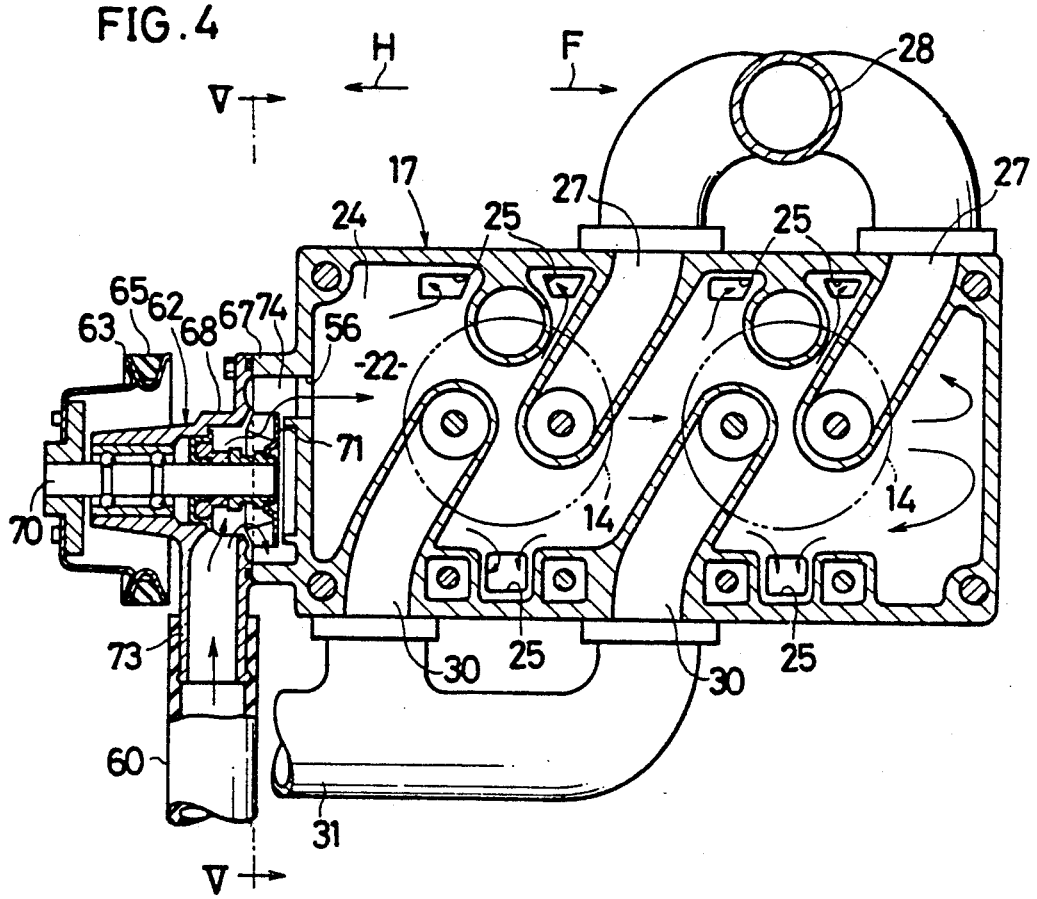
Figure 5:
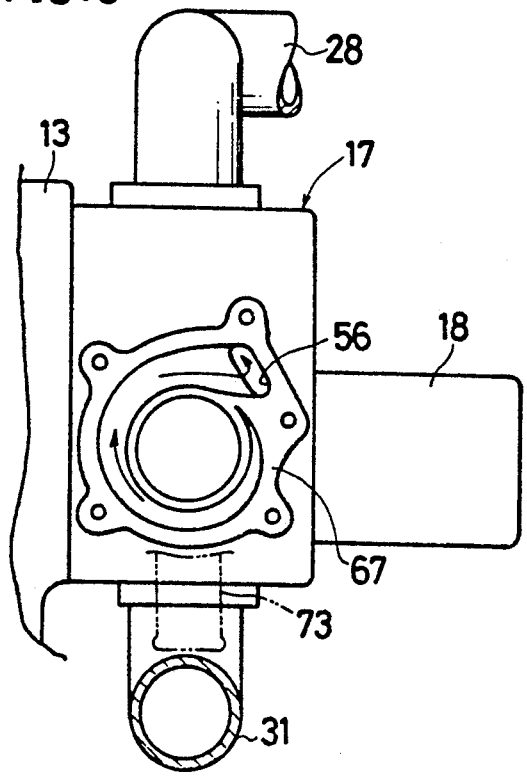

As shown in FIGS. 4 and 5, the water pump 62 is mounted on the cylinder head 17.

A pump mounting seat 67 is formed on the backside of the cylinder head 17 around the cooling water inlet 56 in such a state to be protruding backwardly. A pump casing 68 is fixedly secured on the pump mounting seat 67 and supports the pump shaft 70 rotatably in such a state as to be projecting backwardly. The front end of the pump shaft 70 is equipped with a vane wheel 71, and the back end thereof is equipped with the pump input pulley 63. A suction nozzle 73 of the pump casing 68 is connected to the cool water pipe 60 and a delivery port 74 of the water pump 62 is in communication with the cooling water inlet 56 in the fore and back direction.

The engine generator 1 arranged as mentioned above operates as follows.

The engine body 7 is started by driving the starter motor 40 by means of the battery 11 and then the generator 8 begins generating electrical energy.

The water pump 62 is driven through the driving belt 65 simultaneously with the starting of the engine body 7. The fan-driving motor 48 is driven by means of the electrical power of the battery 11 or from the generator 8 so that the radiator fan 46 serves to supply the radiator 10 with the cooling air.

Then the cooling water within the radiator 10 is delivered under pressure to the water jacket 22 by means of the water pump 62 so as to be circulated to the radiator 10, and in the result the engine body 7 is cooled forcedly thereby. That is, while the cooling water delivered to the head jacket 24 through the cooling water inlet 56 by the water pump 62 is flowing out of the hot water outlet 58 through the cylinder jacket 23, the cooling water cools the cylinder head 17 and the cylinders 14 and gets hotter gradually. Then the hot water is sent to the radiator 10 through the hot water pipe 59 and radiates the heat there to become cool water. The cool water is returned to the water jacket 22 through the cool water pipe 60 by means of the water pump 62 so as to carry out the circulation of the cooling water through the cooling system.

In this case, as shown in FIG. 4, the cooling water delivered under pressure to the water jacket 22 by the water pump 62 is adapted to impinge against the front wall of the cylinder head 17 from the back side thereof and then turn to circulate vigorously within the head jacket 24. After that, the cooling water is adapted to flow into the cylinder jacket 23 through the upper and the lower jacket communication ports 25, 25. In this way, since the cooling water circulates vigorously throughout the head jacket 24 and flows therethrough sufficiently, the whole of the cylinder head 17 can be cooled intensively.

Since the radiator fan 46 is located so as to carry out the forced draft cooling relative to the radiator 10, the radiator fan 46 does not suffer an intensive heating by the hot air exhausted from the radiator 10 hence, the radiator fan 46 can be made of a plastics material and manufactured at a low cost and is light in weight.

Further, the atmosphere sucked by the operation of the radiator fan 46 through air suction openings 76 provided in the right side wall 2*c* of the soundproof casing 2 serves to cool the generator 8, the cylinder head 17 and the exhaust pipe 31 of the engine body 7 and then cool the hot water within the radiator 10. The atmosphere is heated during such a cooling, and then exhausted outside the soundproof casing 2 through exhaust openings 77 provided in the left side wall 2*d* thereof. Since the intake pipe 28 and the exhaust pipe 31 of the engine body 7 are arranged apart in the opposite direction of the fore and back one, the intake pipe 28 is prevented from being heated by the exhaust pipe 31. Therefore, the charging efficiency for the intake air is enhanced and the output power of the internal-combustion engine 6 is increased.

Further, since the cooling air for the radiator 10 is adapted to pass from the cylinder head 17 side to the radiator 10 side so that the heat radiated from the cylinder head 17 can be exhausted smoothly outside the soundproof casing 2, heat stagnation in the upper apace within the soundproof casing 2 can be effectively prevented. Accordingly, the temperature within the soundproof casing 2 can be kept comparatively low and the reliabilities of the control electric appliances within the soundproof casing 2 can be enhanced even if they are arranged therewithin.

As a transmission means for the water pump 62, loop-shaped transmission means such as the pulleys and the belt are used in the above-mentioned embodiment, but sprocket wheels and a chain may be used instead.

Further, instead of the two-cylinder type diesel engine, a single-cylinder type one or a gasoline engine may be adopted as the engine body 7 of the internal-combustion engine 6.

FIGS. 6 through 9 show variant examples, wherein the component parts having the same functions as the ones in the above-mentioned embodiment will be explained with identification by the same symbols hereinafter.

Figure 6:
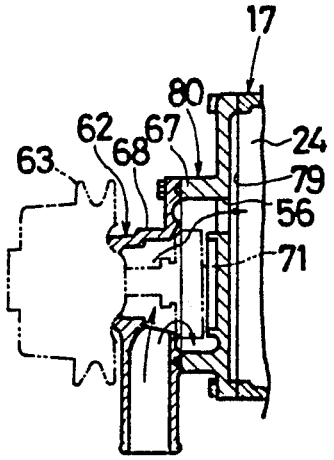

FIG. 6 shows the first variant example, wherein the mounting construction for the water pump 62 is modified as follows. An opening 79 is provided at the backside of the cylinder head 17, and a side cover 80 is provided there so as to cover the opening 79. The pump mounting seat 67 is formed on the backside of the side cover 80 and has the water pump 62 mounted thereon.

Figure 7:
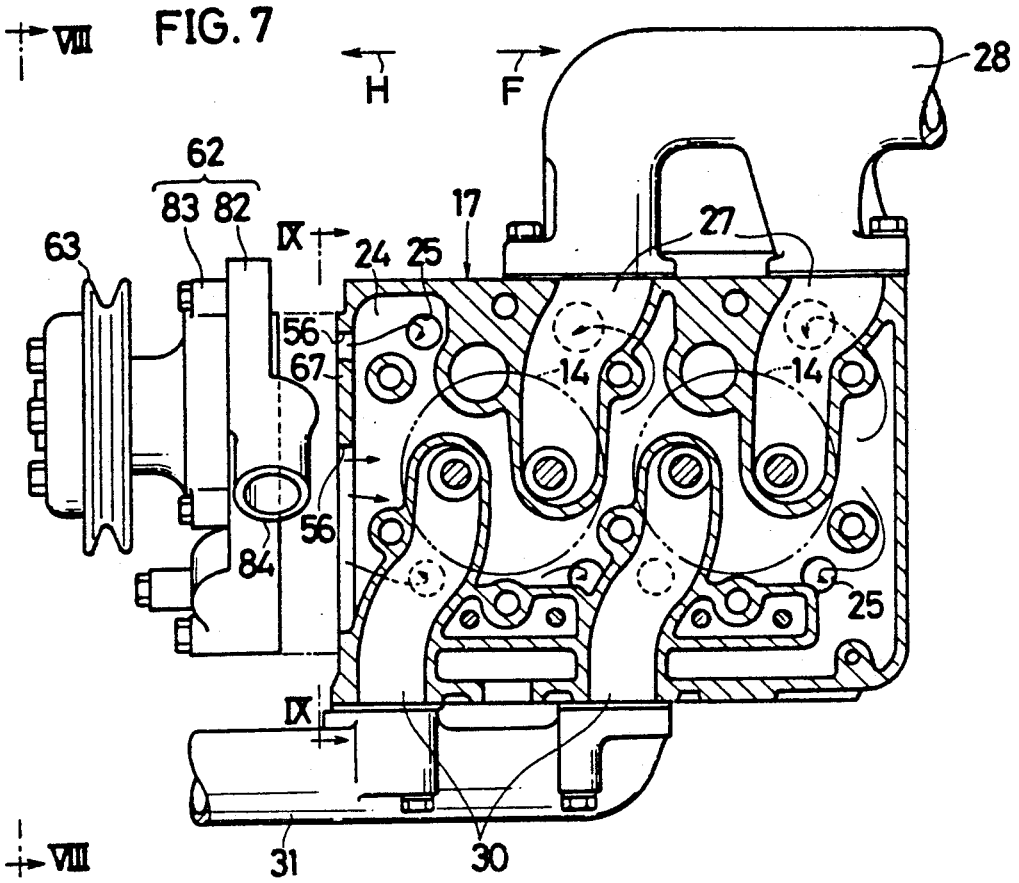
Figure 8:
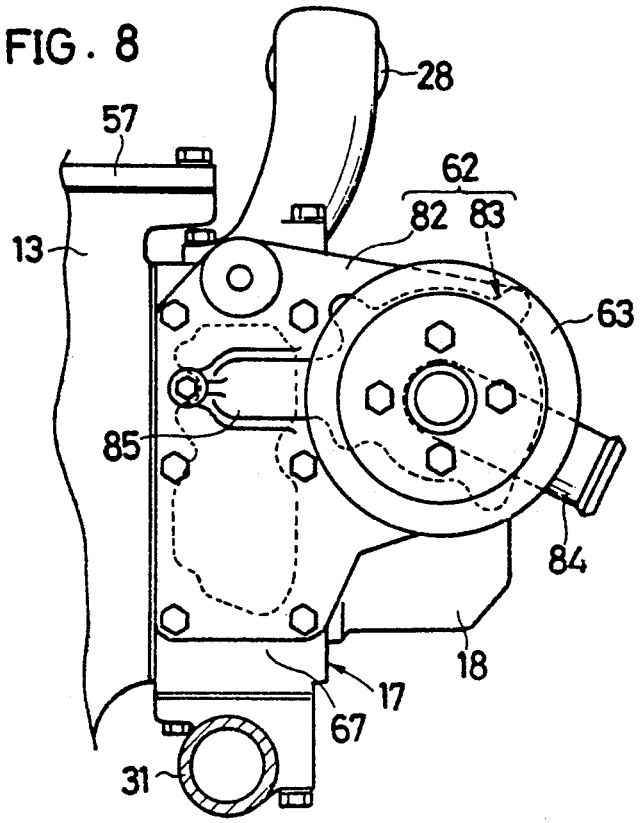
Figure 9:
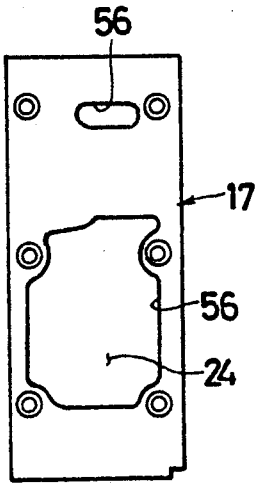
Figure 10:
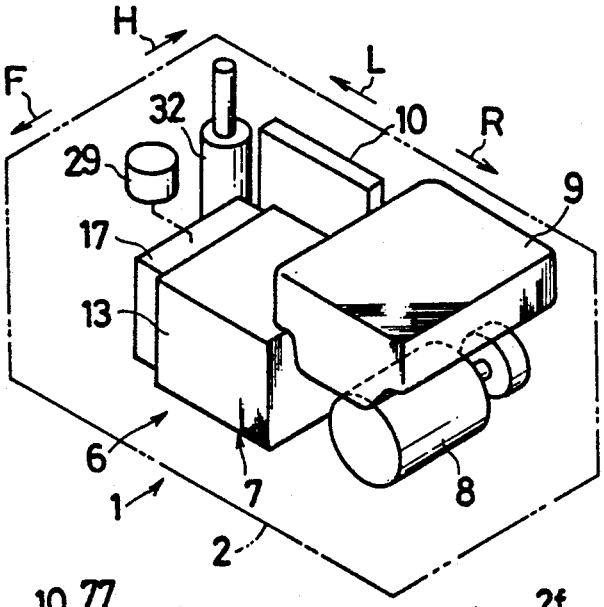
Figure 12:
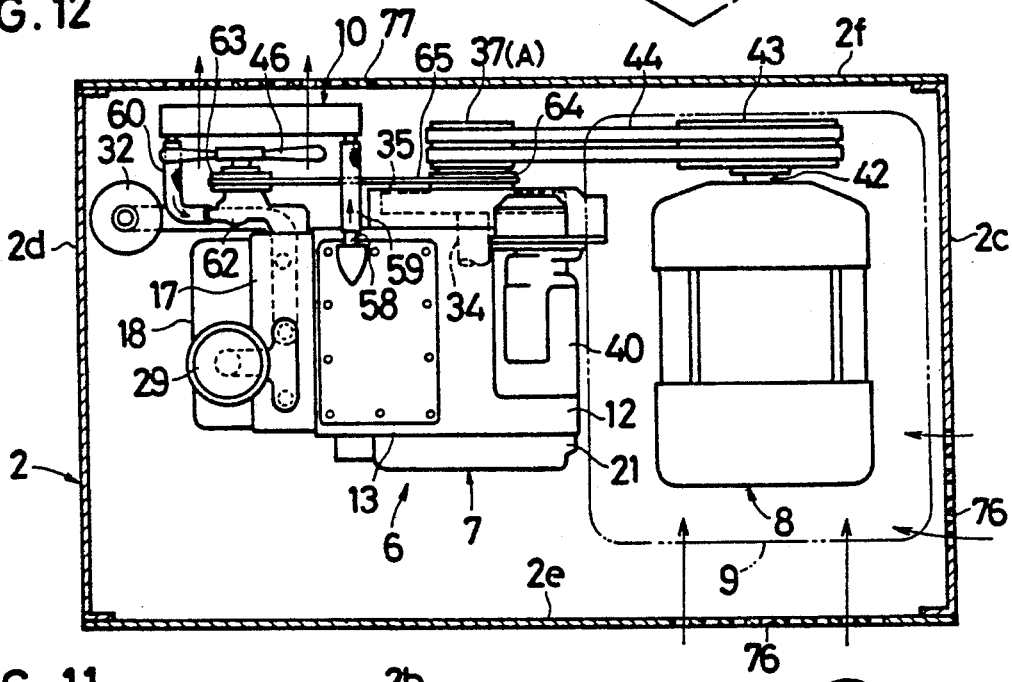
Figure 11:
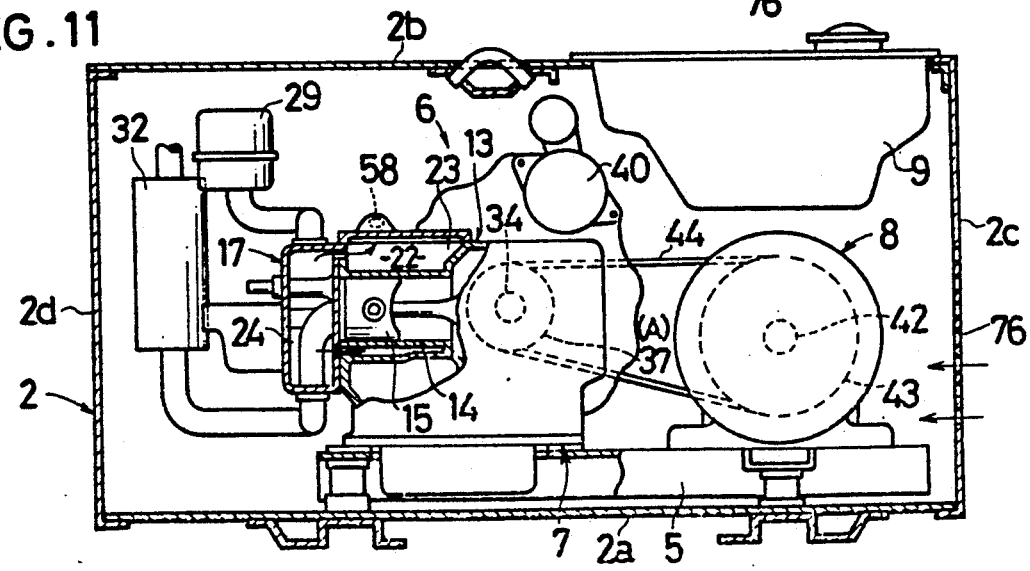
Figure 13:
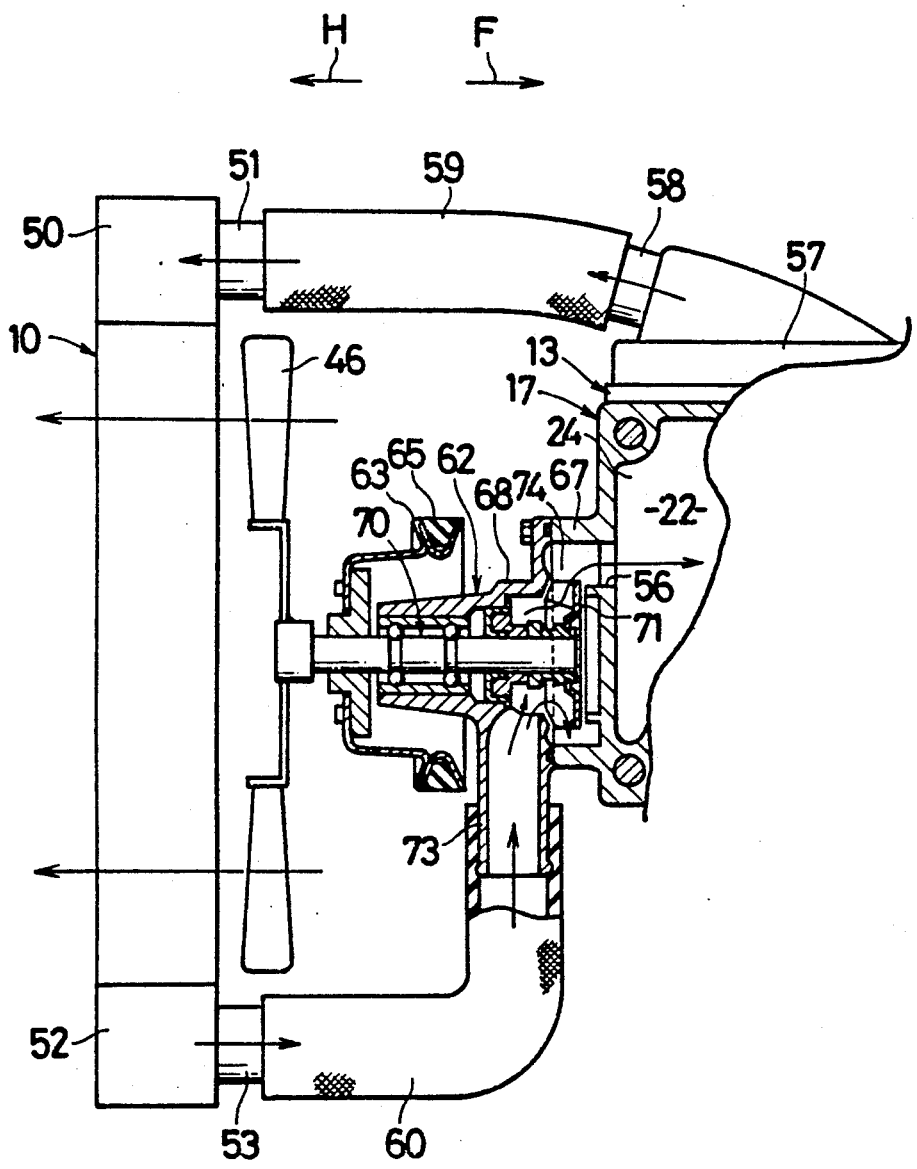
Figure 14:
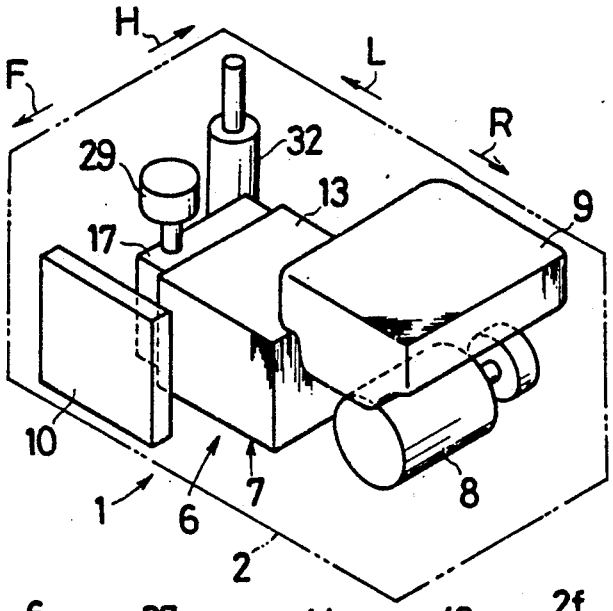
Figure 16:
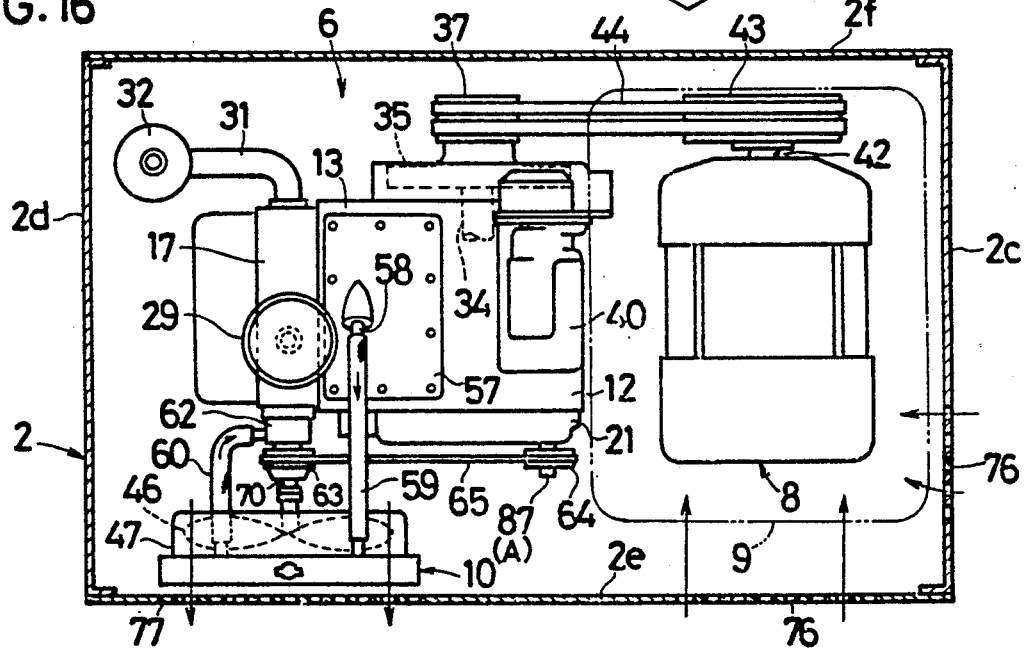
Figure 15:
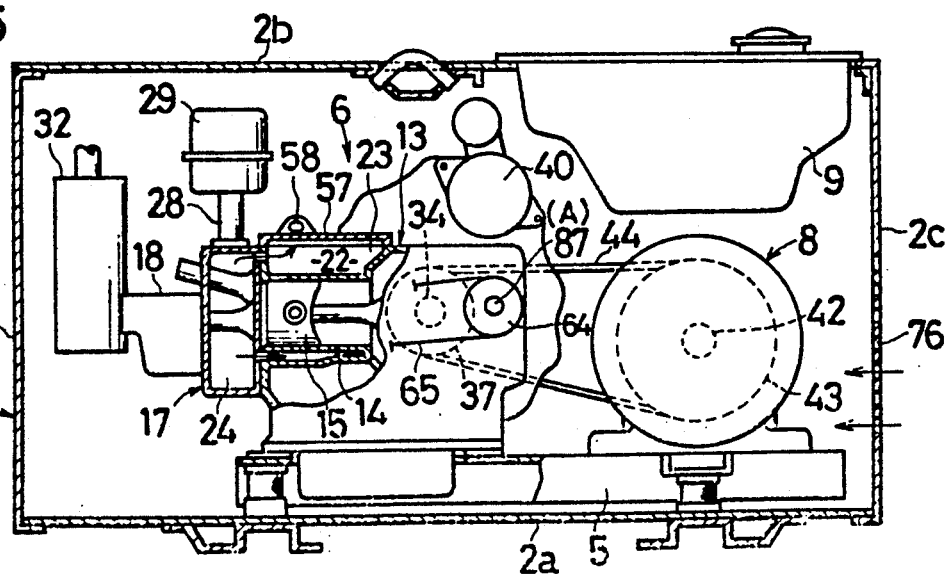
Figure 17:
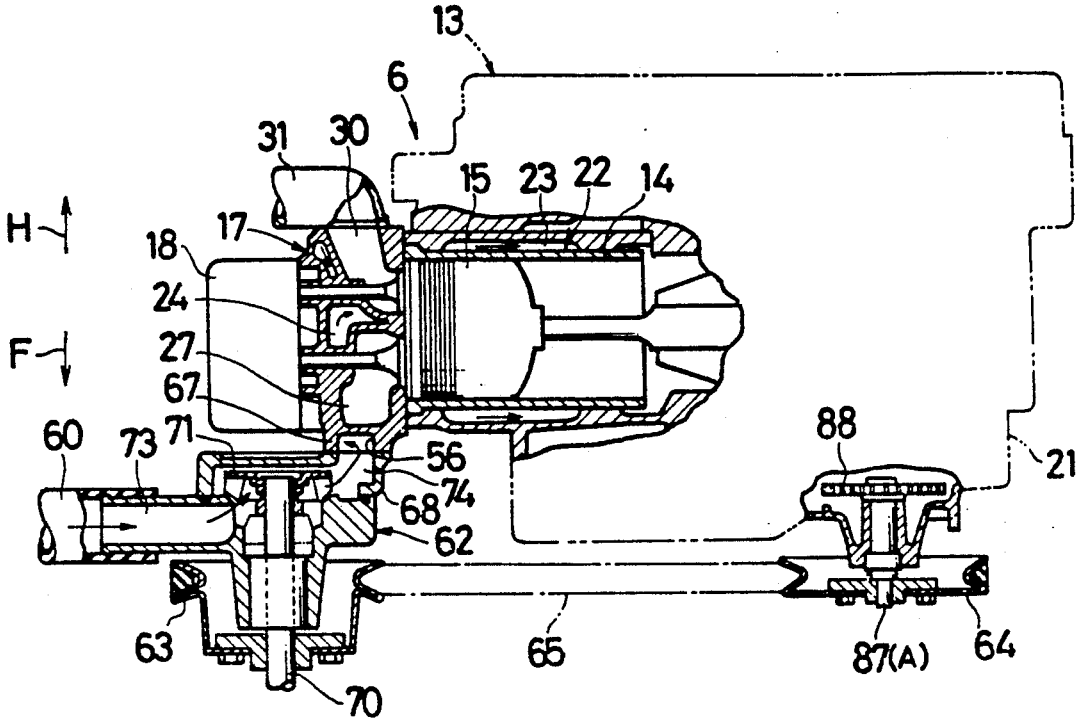

FIGS. 7 through 9 show the second variant example, wherein the water pump 62 comprises a pump casing 82 and a pump body 83 which are constructed so as to be separable from each other in the fore and back direction. At the back wall of the cylinder head 17, there are provided the upper and the lower cooling water inlets 56, 56 and the pump mounting seat 67, on which the pump casing 82 is mounted so as to cover the cooling water inlets 56, 56. The pump casing 82 has a suction nozzle 84 protruded slantly downward and a delivery nozzle 85 formed at the center thereof so as to be oriented to the cooling water inlets 56.

FIGS. 10 through 18 show other embodiments, wherein only the different constructions from the above-mentioned first embodiment will be explained hereinafter. The component parts having the same functions as the ones in the above-mentioned first embodiment are indicated by the same symbols.

FIGS. 10 through 13 show the second embodiment, wherein the radiator 10 is so arranged that it extends in the left and right direction in the left side portion of the back side space outside the engine body 7. The air cleaner 29 is located above the cylinder head 17, and the muffler 32 is located in the left and back side space outside the cylinder head 17. The radiator 10 is constructed the same as the above-mentioned forced draft type one and equipped with the radiator fan 46 orientated to the air inlets at the front side thereof. The radiator fan 46 is fixedly secured to the back end portion of the pump shaft 70 of the water pump 62. The water pump 62 and the radiator fan 46 are adapted to be driven through the driving belt 65 simultaneously with the operation of the engine body 7.

The atmosphere sucked by the operation of the radiator fan 46 through the air suction openings 76 provided in the right side portion of the front wall 2*e* and in the right side wall 2*c* respectively is heated during the cooling of the hot water within the radiator 10 and exhausted outside the soundproof casing 2 through the exhaust openings 77 provided in the left side portion of the back wall 2*f* thereof.

FIGS. 14 through 18 show the third embodiment, wherein the engine body 7 of the internal-combustion engine 6 is constructed for a single-cylinder type diesel engine, and the radiator 10 is located in such a state as to be extending in the left and right direction in the left side portion of the front side space outside the engine body 7. The air cleaner 29 is located above the cylinder head 17, and the muffler 32 is located in the left and back side space outside the cylinder head 17. The radiator 10 is constructed the same as the above-mentioned forced draft type one and is equipped with the radiator fan 46 oriented to the air inlets at the backside thereof.

In the water jacket 22 for the engine body 7, the cooling water inlet 56 is provided in the front wall of the cylinder head 17 opening in the fore and back direction, and the hot water outlet 58 is provided in the jacket cover 57 for the cylinder jacket 23. The water pump 62 is mounted on the pump mounting seat 67 formed around the cooling water inlet 56. The delivery port 74 of the water pump 62 is in communication with the cooling water inlet 56 in the fore and back direction. The radiator fan 46 is fixedly secured to the front end portion of the pump shaft 70 which extends in the water pump 62 in the fore and back direction.

On the other hand, the pump driving shaft 87 (rotation shaft A) projects forward from the right and upper portion of the gear casing 21. The pump driving shaft 87 is interlockingly connected to the crankshaft 34 through the driven gear 88 secured to the back end portion thereof and the gear transmission means within the gear casing 21. The pump driving pulley (pump driving wheel) 64 is fixedly secured to the front end portion of the pump driving shaft 87. The pump input pulley (pump input wheel) 63 is fixedly secured to the pump shaft 70 of the water pump 62. Around these both pulley 63, 64, the pump driving belt (wrapping connector) 65 is looped continuously under tension so that the water pump 62 and the radiator fan 46 can be driven simultaneously by the operation of the engine crankshaft.

Figure 18:
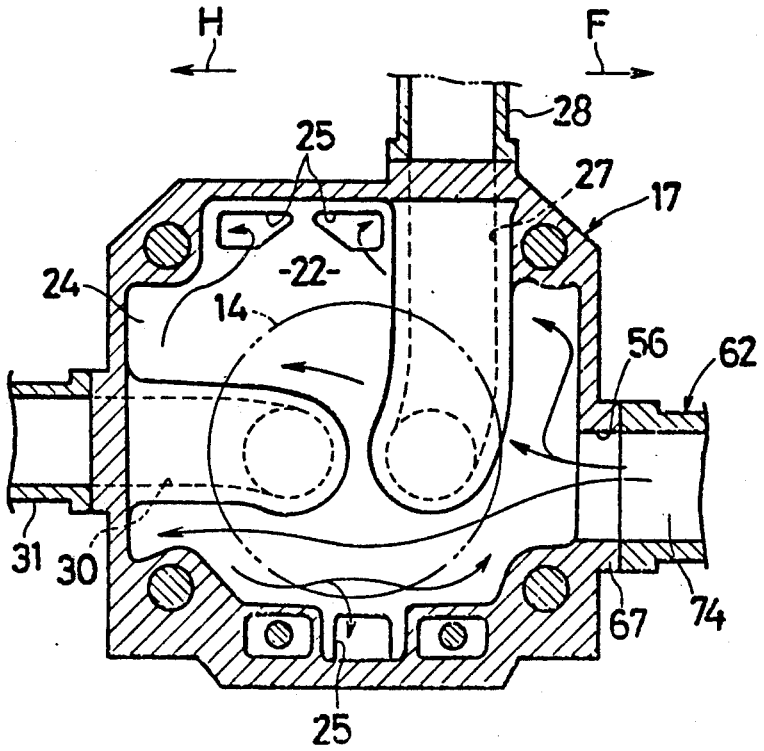
Figure 19:
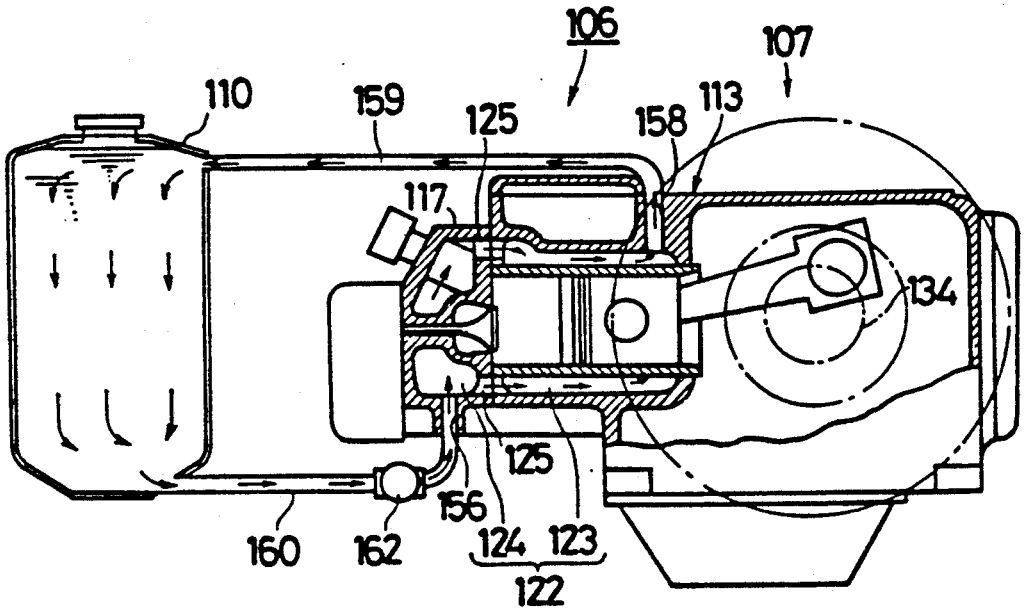
FIG. 19 (PRIOR ART)
FIG. 19 is a schematic vertical sectional view of a conventional horizontal internal-combustion engine.

As shown in FIG. 18, the cooling water delivered to the water jacket 22 by the operation of the water pump 62 is adapted to flow thereinto vigorously from the front side of the cylinder head 17 and impinge against the back wall thereof. Thereupon, the cooling water turns its flowing direction so as to circulate vigorously throughout the cylinder jacket 24, and a portion of the circulating cooling water flows into the cylinder jacket 23 through the jacket communication ports 25. In this way, since the cooling water circulates vigorously throughout the head jacket 24 and flows therethrough its entirety, the whole of the cylinder head 17 can be cooled intensively.

The atmosphere sucked by the operation of the radiator fan 46, through the air suction openings 76 respectively provided in the right side portion of the front wall 2*e* and the right side wall 2*e* of the soundproof casing 2, is heated during the cooling of the hot water within the radiator 10 and is exhausted outside the casing 2 through the exhaust openings 77 provided in the left side portion of the front wall 2*e*.

Still other objects and advantages of the present invention will become readily apparent to those skilled in this art from the preceding detailed description, wherein only the preferred embodiments of the invention are illustrated and described as aforementioned, simply by way of presenting the best modes contemplated of carrying out the invention. As will be realized, the invention is capable of other and different embodiments, and its several details are capable of modification in various obvious respects, all without departing from the invention. Accordingly, the drawing and description are to be regarded as illustrative in nature, and not as restrictive, the invention being defined solely by the claims appended hereto.

I claim:

1. A forced-circulation type water-cooling system for a horizontal internal-combustion engine having a front and a back along a fore and back direction, comprising:

an engine body formed with a cylinder jacket to cool a horizontal engine cylinder, said cylinder jacket having at upper and lower portions thereof a plurality of cylinder jacket communication ports, said engine body further comprising a cylinder head having a cylinder head jacket provided with a plurality of head jacket communication ports disposed in correspondence with the cylinder jacket communication ports and in communication therewith, the cylinder head being fixed to a lateral surface of the cylinder block, the cylinder head jacket being provided with a cooling water inlet at a mid-height portion one of a front surface and a rear surface thereof, and the cylinder water jacket being provided with a heated water outlet;

a radiator located in a surrounding space outside the engine body and positioned laterally thereof;

a water pump mounted to the cylinder head to receive cooled water from a bottom position of said radiator, for directing said cooled water under pressure to an internal surface of said cylinder head of said engine to generate violent circulation by being forced to flow divergingly upward and downward thereat, the upward cooling water flow turning in the cylinder head jacket to flow through the upper ones of said communication ports into the cylinder jacket and the downward cooling water flow turning in the cylinder head jacket to flow through the lower ones of said communication ports into the cylinder jacket for thereby efficiently cooling the cylinder head, the radiator being connected to receive water flow from the cylinder jacket to cool the same for recirculation by the water pump;

a pump mounting seat for the water pump being provided at the cylinder head adjacent one of the front and the back of the engine, the water pump being mounted on the pump mounting seat with a pump shaft extending in the fore and back direction; and a pump driving wheel fixedly secured to a rotation shaft projecting from one of the front and back the engine, at the same side as the water pump mounting side, the pump driving wheel being interlockingly connected through a wrapping connector to a pump input wheel fixedly secured to the pump shaft.

2. A forced-circulation type water-cooling system for a horizontal internal-combustion engine as defined in claim 1, wherein:

the radiator is equipped with a radiator fan oriented in a predetermined manner with respect thereto said fan being driven by an electric motor.

3. A forced-circulation type water-cooling system for a horizontal internal-combustion engine as defined in claim 1, wherein:

the radiator is arranged in a laterally oriented state in a lateral space outside the cylinder head so that the cooling air flows passes by in a lateral direction with respect to the engine body.

4. A forced-circulation type water-cooling system for a horizontal internal-combustion engine as defined in claim 3, wherein:

the radiator fan is interposed between the radiator and the cylinder head and is positioned so as to generate a forced draft of cooling air relative to the radiator to cool the same.

5. A forced-circulation type water-cooling system for a horizontal internal-combustion engine as defined in claim 1, wherein:

the radiator is located in such a state as to be oriented in the fore and back direction outside and near the back of the cylinder head so that the cooling air flow passes by in the fore and back direction.

6. A forced-circulation type water-cooling system for a horizontal internal-combustion engine as defined in claim 1, wherein:

the radiator is arranged in such a state as to be oriented in the fore and back direction outside and near the front of the cylinder head so that the cooling air flow passes by in the fore and back direction.

7. A forced-circulation type water-cooling system for a horizontal internal-combustion engine as defined in claim 1, wherein:

the water pump is mounted on one of the front and back opposite sides of the cylinder head, at the same side as the radiator is located;

a pump input wheel and the radiator fan are fixedly secured to the projecting end portion of the pump shaft of the water pump, with the pump shaft projecting outwardly in the fore and back direction; and the radiator is located so as to be oriented to the radiator fan.

8. A water-cooling system for an engine according to claim 1, wherein:

said air-flow forcing means comprises a rotary fan element mounted to rotate in correspondence with said rotatable element of said pump means.

9. A water-cooling system for an engine according to claim 1, wherein:

said fan element and said rotatable element of said pump means are mounted coaxially on a common shaft.

10. A water-cooling system for an engine according to claim 1, wherein:

a fan element is disposed to generate an air flow past an outside surface of said engine body along said cylinder jacket, past said cylinder head, and then through said radiator in a direction away from the engine.

* * * * *